US006408930B1

(12) United States Patent
von Wyl et al.

(10) Patent No.: US 6,408,930 B1
(45) Date of Patent: Jun. 25, 2002

(54) ADJUSTABLE PLATE MOLD

(75) Inventors: Horst von Wyl, Duisburg; Hans Siemer, Essen; Axel Scholz, Duisburg, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/392,051

(22) Filed: Sep. 8, 1999

(30) Foreign Application Priority Data

Sep. 8, 1998 (DE) ..... 198 42 110

(51) Int. Cl.[7] ..... B22D 11/04; B22D 11/10
(52) U.S. Cl. ..... 164/436; 164/491
(58) Field of Search ..... 164/436, 491

(56) References Cited

U.S. PATENT DOCUMENTS 3,710,845 A * 1/1973 Burkhardt et al. ..... 164/273
3,735,801 A * 5/1973 Burkhardt ..... 164/273
3,926,244 A * 12/1975 Meier et al. ..... 164/4
4,719,966 A * 1/1988 Röhrig ..... 164/491
5,205,345 A * 4/1993 McClellan et al. ..... 164/452
5,307,862 A * 5/1994 Sakata et al. ..... 164/436
5,533,564 A * 7/1996 Alberola et al. ..... 164/342

* cited by examiner

*Primary Examiner*—M. Alexandra Elve
*Assistant Examiner*—Kevin McHenry
(74) *Attorney, Agent, or Firm*—Cohen, Pontani, Lieberman & Pavane

(57) ABSTRACT

An adjustable plate mold includes two broad-side walls and first and second narrow-side walls clampable between the two broad-side walls to define a size if a slab formable by the plate mold. A frame work includes cassette holders corresponding to the narrow-side walls. Actuating elements are inserted in the cassette holders and connected to the first and second narrow-side walls for moving the first and second side walls to change the size of the slab formable by the plate mold. The framework also includes a holding part for maintaining the narrow-side walls at a constant horizontal level relative to the cassette holders.

9 Claims, 5 Drawing Sheets

ADJUSTABLE PLATE MOLD

BACKGROUND OF THE INVENTION

1. Field of the Invention

The invention is directed to an adjustable plate mold with narrow-side walls which can be clamped between broad-side walls and which are articulated in each instance in the upper and in the lower outwardly directed edge area of the narrow-side walls at an actuating drive inserted in a cassette holder.

2. Description of the Related Art

A process for changing a strand cross section format and a mold for carrying out the process are known from German reference No. DE-OS 29 23 113, wherein actuating drives mounted in a frame surrounding the side walls of the mold are articulated at the narrow-side walls. The actuating drives can be actuated independently from one another and at least one actuating drive is mounted at the frame in an articulated manner, i.e., so as to permit a swiveling movement in the plane of symmetry parallel to the broad-side walls.

Adjusting devices for molds constructed in this way have the disadvantage that the adjusting device must absorb shearing forces at least outside of the clamping phase of the narrow-side walls by the broad-side walls—i.e., when the narrow-side walls are not clamped by the broad-side walls.

A further disadvantage of this device is that the narrow-side walls are lifted out of the broad-side walls by a rocking or swaying motion of the narrow-side walls. During this type of swaying motion of the narrow sides in the known device, the narrow side describes a circular path about the center of rotation of the narrow-side drive during the straight-line guidance stage of the slab being formed.

Also known in practice are narrow-side walls which are movable on a horizontal path by a type of tongue-and-groove guide. This type of guide is disadvantageous because the guides are exposed to a high degree of contamination during the harsh steelmaking operation and because of the related high maintenance costs.

SUMMARY OF THE INVENTION

It is an object of the present invention to overcome the problems of the prior art and to provide an adjustable plate mold having narrow-side walls between broad-side walls in which a horizontal position of the narrow-side walls is adjustable to a predetermined position during a change in the slab format in a simple manner, without obstruction and with low maintenance.

This object of the present invention is achieved by an adjustable plate mold for forming a slab having a cross-section of predetermined length and width, comprising sidewalls defining a length and a width of the slab to be formed including a pair of opposing broad-side walls and first and second narrow-side walls clampable between the broad-side walls, and a framework including first and second cassette holders respectively corresponding to the first and second narrow-side walls, first and second actuating devices respectively inserted in the first and second cassette holders and connected to the first and second narrow-side walls, the first and second actuating devices operatively arranged for respectively moving the first and second narrow-side walls along a horizontal line for adjusting a size of the slab to be output, and first and second holding parts respectively connected between the first and second cassette holders and the first and second narrow-side walls for holding the first and second narrow-side walls at a constant horizontal level along the horizontal line.

According to the invention, holding parts are provided which hold the narrow-side walls on a predefinable horizontal line. These holding parts, together with the actuating drives and the narrow-side walls and cassette holders, form a framework. This particularly rigid construction prevents any swaying movement of the narrow-side walls. At the same time, the desired position of the narrow-side walls is exactly maintained, especially when the narrow-side walls are not clamped by the broad-side walls—i.e., outside of the clamping phase of the narrow-side walls by the broad-side walls.

In one embodiment, the holding part is a rod guided at an angle to the respective narrow-side wall and adjustable in length. The other end of the rod may be fastened to a cassette holder which supports the actuating device for the respective narrow-side wall and is guided diagonal to the frame formed of the actuating drives, narrow-side walls and cassette holders. Two diagonal rods which are constructed as piston-cylinder units or electric linear drives are preferably provided.

In another embodiment, the rod has a thread that corresponds with a spindle nut which is fastened to the cassette holder. This rod is dimensioned such that it can reliably assume the anticipated tensile and compressive forces. The movement of the adjusting drives is carried over to the spindle nut in a corresponding manner and the length of the diagonal rod of the framework is correspondingly changed.

In another embodiment, the holding part is a rope connected with a drivable rope drum arranged at the cassette holder. Since the rope can only receive tensile forces, a second rope is installed insofar as the holding part must also absorb compressive forces, wherein this second rope is arranged symmetric to the first holding part with respect to tilt and, through the reversal, takes over the compressive forces.

In yet another embodiment, the holding part is a simple rod which is connected to a two-arm lever. A first arm of the two-arm lever connected to the rod is so dimensioned that it supports negligibly small bending forces, so that the rod forms a complete framework with the narrow-side walls and the actuating drive.

A measuring and regulating device is suitably connected with the actuating drives on the one hand and with the drives of the holding part for providing reliable adjustment of the narrow-side walls.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
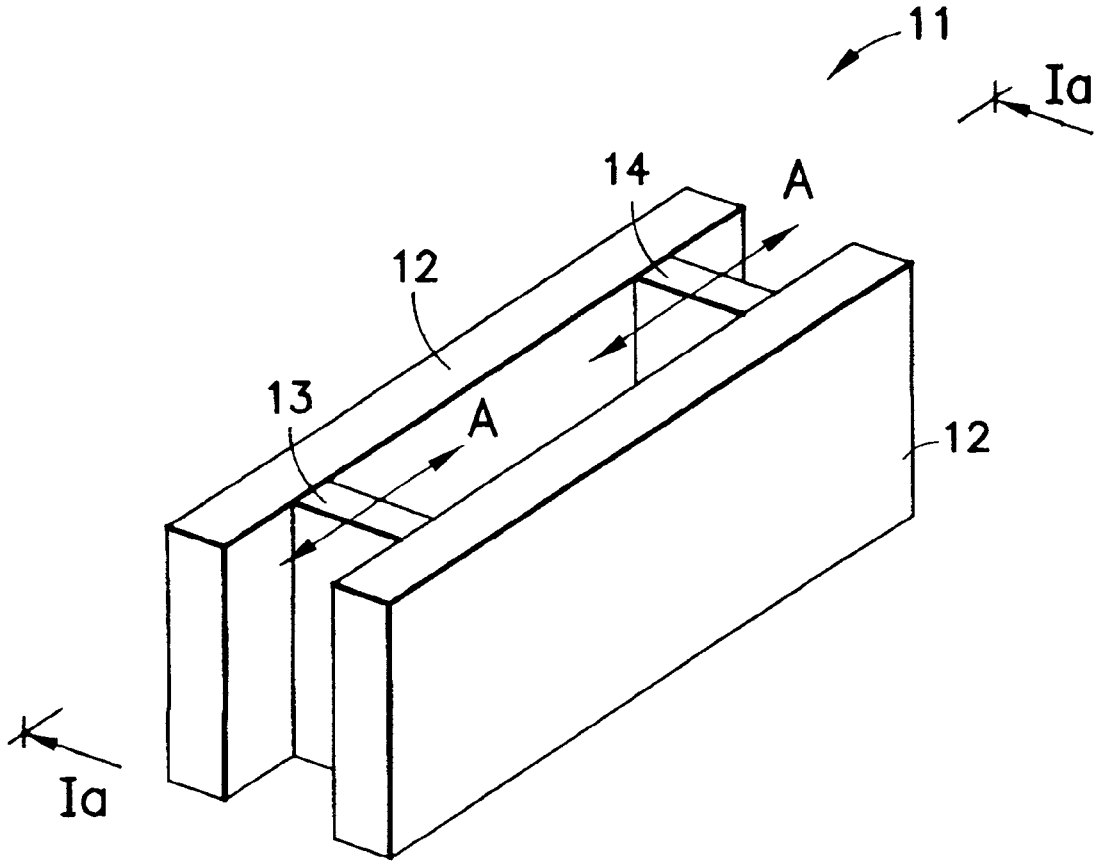
FIG. 1 is a perspective view of an adjustable plate mold according to an embodiment of the present invention.

Referring to FIG. 1, an adjustable plate mold 11 according to the invention includes stationary broad-side walls 12 and movable narrow-side walls 13 and 14 which are individually adjustable along arrows A for adjusting a length of the slab to be molded.

Figure 1A:
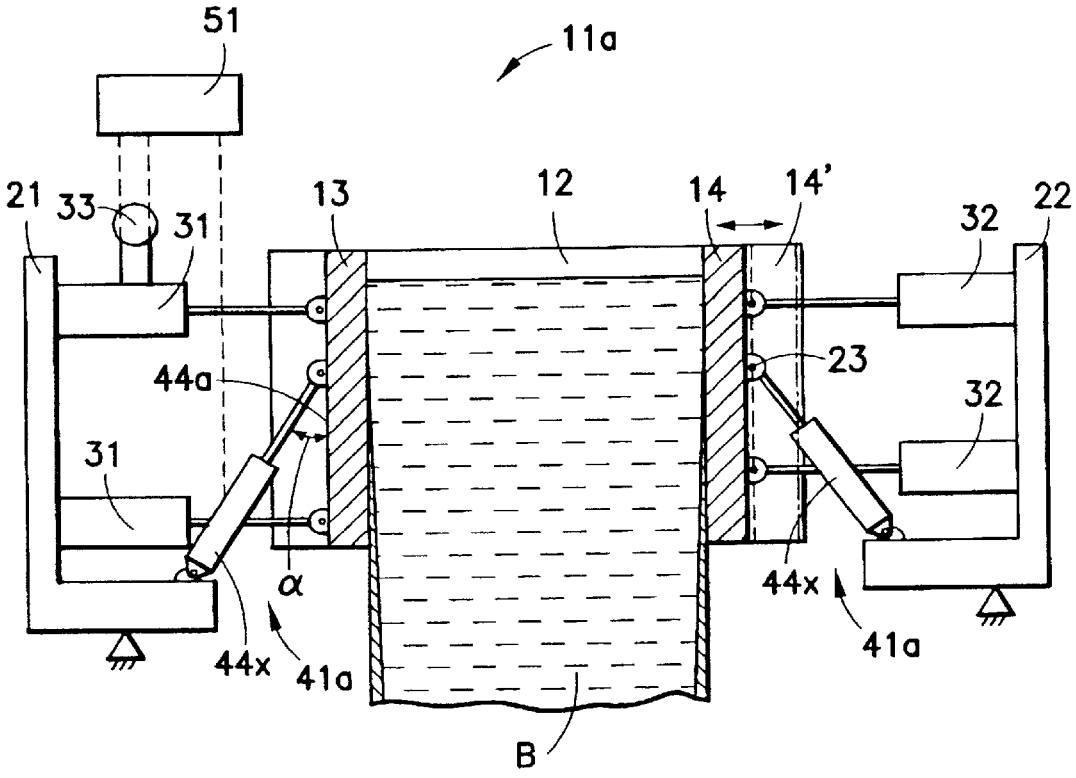
FIG. 1*a* shows an adjustable plate mold according to an embodiment of the present invention including a holding element as a rod with adjustable length.

In FIG. 1*a*, the individual narrow-side walls 13 or 14 of an adjustable plate mold 11*a* are connected via actuating drives 31 and 32, respectively, with cassette holders 21 and 22. The actuating drives 31 and 32 are respectively inserted in cassette holders 21 and 22. In the particular embodiment shown in FIG. 1*a*, the actuating drives 31 and 32 are arranged on the respective narrow-side wall 13 or 14 such that they face the cassette holders 21 and 22. The actuating drives 31, 32 comprise hydraulic piston-cylinder units and a pump 33 is provided for providing hydraulic media to these actuating drives 31, 32. The actuating drives are arranged in the cassette holders 21, 22 for adjusting the horizontal positions of the narrow-side walls 13, 14 such that various size slabs may be made using one adjustable plate mold 11.

The embodiment of FIG. 1*a* also shows a holding part 41*a* which is used to maintain the narrow-side walls 13 and 14 at a horizontal position during formation of a slab B. Holding part 41*a* comprises a rod 44*a* moveable in a cylinder 44*x*, the holding part having an adjustable length connected between each narrow-side wall 13, 14 and the cassette holders 21, 22. Each holding part 41*a* is arranged such that one end is supported at one of the cassette holders 21, 22 and the other end is respectively supported at one of the narrow-side walls 13, 14. The holding parts 41*a* are guided at an angle $\alpha$ relative to the narrow-side walls 13, 14. The holding part 41*a* provides support such that the narrow-side walls 13, 14 are maintained at a constant position during formation of the slab B and when they are not clamped between the broad-side walls 12.

On the right-hand side of FIG. 1*a*, two different possible positions of the narrow-side wall 14 and 14' are shown. The upper left-hand part of the drawing also shows a measuring and regulating device 51 which is provided at one end with the pump 33 for supplying media to the actuating drive 31 and is further connected, in a suitable manner with respect to regulating technique, with the holding part 41*a* for adjusting the length thereof. The measuring and regulating device 51 may be similarly connected to the actuating drive 32 and the holding part 41*a* on the right side of the drawing but is not shown for sake of clarity.

Figure 1B:
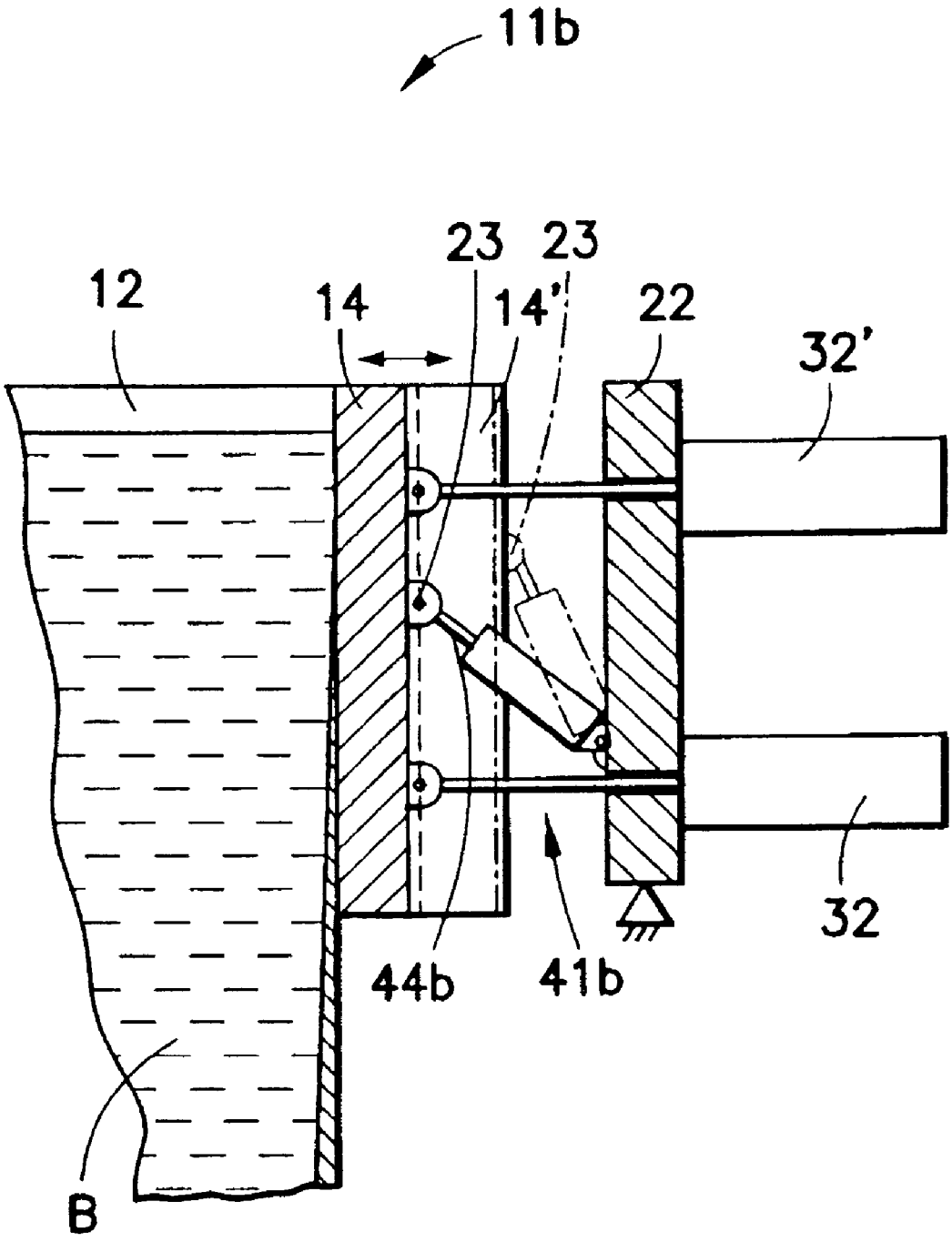
FIG. 1*b* shows the right side of an adjustable plate mold according to another embodiment of the present invention.

FIG. 1*b* shows another embodiment in which an actuating drive 32' is inserted in the cassette holder 22 with its driving part on the side of the cassette holder 22 remote of the mold 11, wherein the drive shaft of the actuating drive 32' is guided through the cassette holder 22 and is fastened in an articulated manner to the narrow-side wall 14. A holding part 41*b* of this embodiment also includes a rod 44*b* having an adjustable length connected between the narrow-side wall 14 and the cassette holder 22. Instead of a hydraulic piston-cylinder unit, actuating drive 32' comprises an electric linear drive.

Figure 2A:
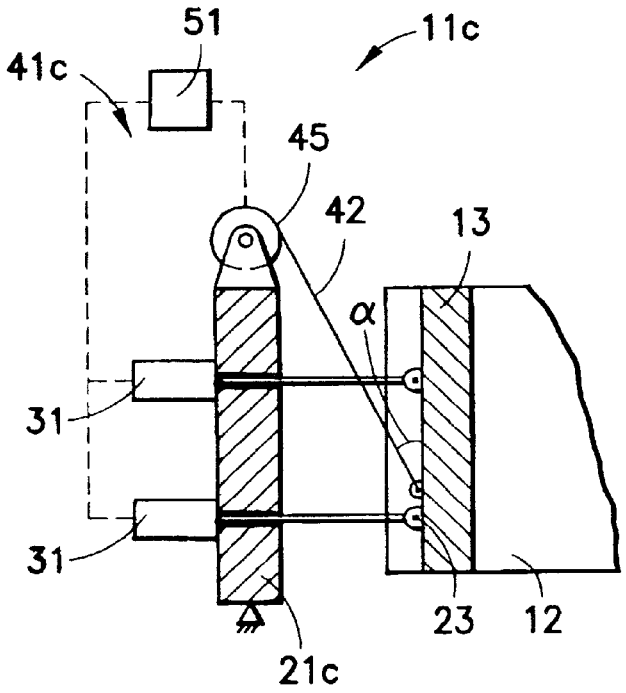
FIG. 2*a* shows the left side of an adjustable plate mold according to another embodiment in which a holding part includes one rope.

A holding part 41*c* in the embodiment of the adjustable plate mold 11*a* shown in FIG. 2*a* includes a drivable rope drum 45 arranged at the head of a cassette holder 21*c*. The drivable rope drum 45 is connected with the narrow-side wall 13 by a rope 42 which is fastened to a holding point 23 of the narrow-side wall 13. The rope 42 is exclusively, and also sufficiently, under tensile load by the inherent weight of the narrow-side walls 13, 14 and broad sides 12.

Figure 2B:
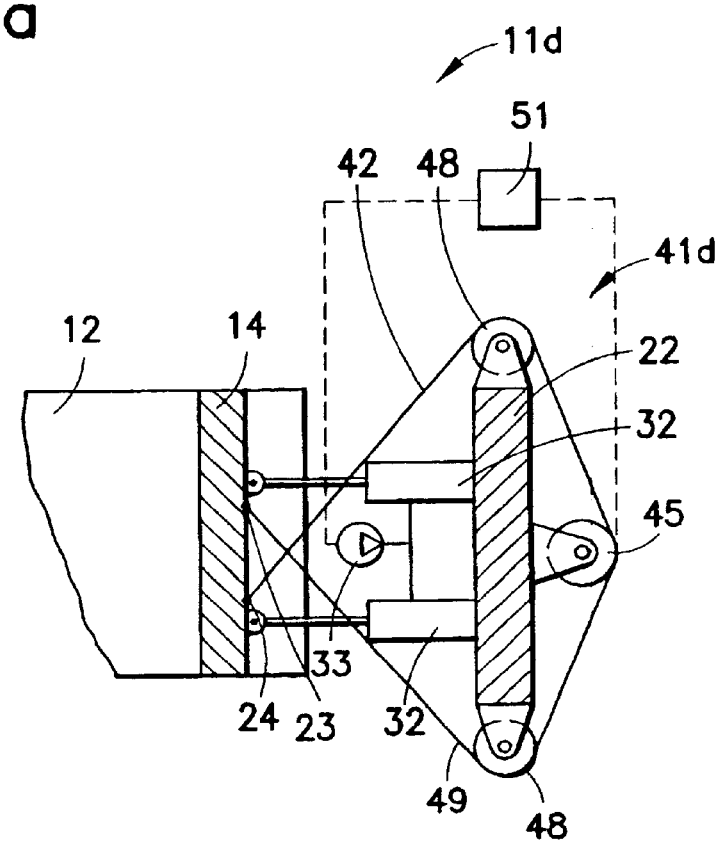
FIG. 2*b* shows the right side of an adjustable plate mold according to another embodiment in which a holding part includes two ropes.

FIG. 2*b* shows a holding part 41*d* including a rope drum 45 mounted on the cassette holder 22 according to a further embodiment. Two ropes 42, 49 proceed from the rope drum 45 and are guided around the cassette holder 22 via respective rollers 48 to holding points 23 and 24 provided at the narrow-side wall 14. The intersecting ropes 42, 49 under tensile loading accordingly function as a holding rod which can absorb both tensile and compressive forces.

Figure 3A:
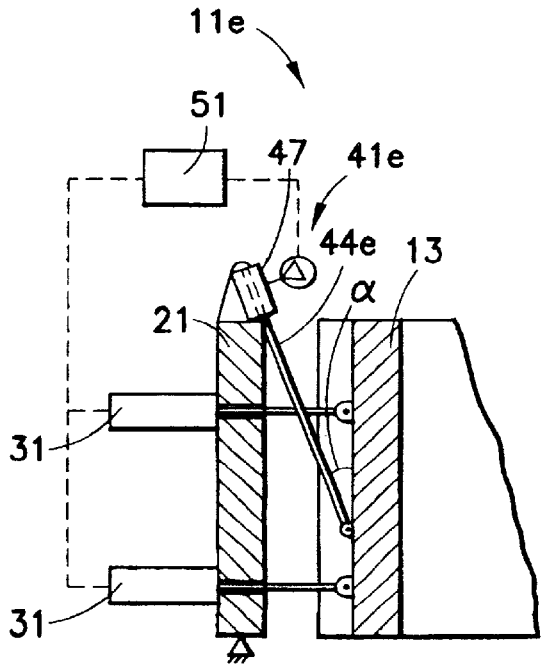
FIG. 3*a* shows the left side of an adjustable plate mold according to another embodiment in which the holding part is a rod with a spindle nut.

FIG. 3*a* shows another embodiment of a holding part 41*e* including a rod 44*e* which is guided at an angle $\alpha$ to the narrow-side wall 13 and has, at the other end, a drivable spindle nut 47 mounted on the cassette holder 21. The drivable spindle nut 47 is suitably connected to a measuring and regulating device 51 which communicates at the same time with actuating drives 31 for coordinating the traveling movement of the narrow-side wall 13 during the breadth or width adjustment.

Figure 3B:
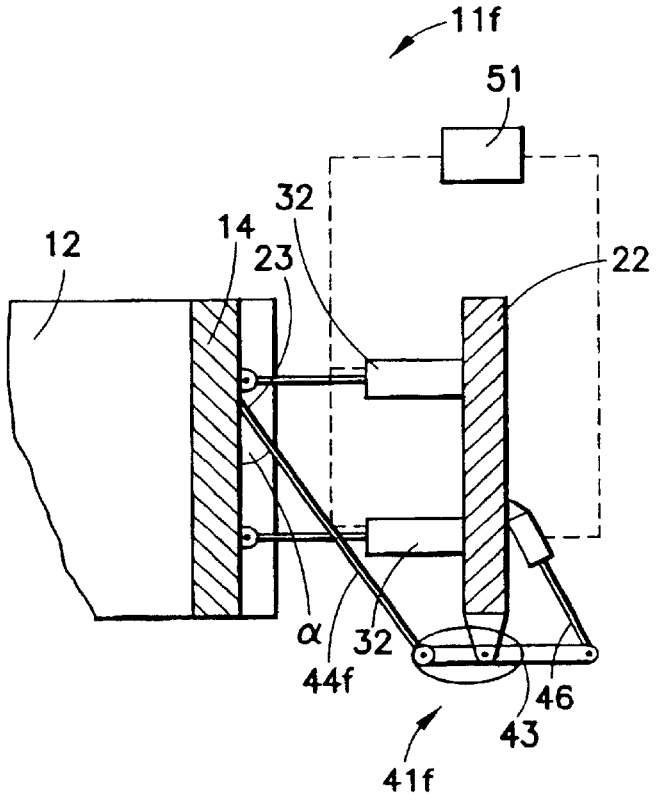
FIG. 3*b* shows the right side of an adjustable plate mold according to yet another embodiment in which the holding part is a two-arm lever.

Yet another embodiment of a holding part 41 (FIG. 3*b*) includes a rod 44*f* fastened in an articulated manner at one end to a holding point 23 of the narrow-side wall 14 and communicates at the other end with a tilt lever 43 which is rotatable about a connection point on the cassette holder 22 to a specific position by a tilt lever drive 46. The tilt lever 43 is a two-arm lever, wherein the lever arm connected with the rod 44*f* is constructed so as to be sufficiently robust that it is subjected to virtually no bending. The tilt lever drive 46 of the tilt lever 43 is suitable connected with the measuring and regulating device 51.

The invention is not limited by the embodiments described above which are presented as examples only but can be modified in various ways within the scope of protection defined by the appended patent claims.

We claim:

1. An adjustable plate mold for forming a slab having a cross-section of predetermined length and width, comprising:

sidewalls defining a length and a width of the slab to be formed including a pair of opposing broad-side walls and first and second narrow-side walls clampable between said broad-side walls; and a framework including first and second cassette holders respectively corresponding to said first and second narrow-side walls, first and second actuating devices respectively inserted in said first and second cassette holders and connected to said first and second narrow-side walls, said first and second actuating devices operatively arranged for respectively moving said first and second narrow-side walls along a horizontal line for adjusting a size of the slab to be output, and first and second holding parts respectively connected between said first and second cassette holders and said first and second narrow-side walls for holding said first and second narrow-side walls at a constant horizontal level along the horizontal line, wherein said first holding part comprises a first rod having an adjustable length and articulately connected between said first narrow-side wall and said first cassette holder, said first rod being guided at an acute angle to said first narrow side wall and non-parallel with said horizontal line, and said second holding part comprises a second rod having an adjustable length and articulately arranged between said second cassette holder and said second narrow-side wall, said second rod being guided at an acute angle to said second narrow-side wall and non-parallel with said horizontal line.

2. The adjustable plate mold of claim 1, wherein said first rod is fastened to said first cassette holder and is guided diagonal to said framework.

3. The adjustable plate mold according to claim 1, wherein each of said first and second rods comprises a piston-cylinder unit.

4. The adjustable plate mold of claim 1, wherein each of said first and second rods comprises an electric linear drive.

5. The adjustable plate mold according to claim 1, wherein each of said first and second rods comprises an external thread and each of said first and second holding parts further comprises a drivable spindle nut fastened to a respective one of said first and second cassette holders, said drivable spindles respectively engaging said external threads for longitudinally extending or retracting said first and second rods.

6. An adjustable plate mold for forming a slab having a cross-section of predetermined length and width, comprising:

sidewalls defining a length and a width of the slab to be formed including a pair of opposing broad-side walls and first and second narrow-side walls clampable between said broadside walls; and a framework including first and second cassette holders respectively corresponding to said first and second narrow-side walls, first and second actuating devices respectively inserted in said first and second cassette holders and connected to said first and second narrow-side walls, said first and second actuating devices operatively arranged for respectively moving said first and second narrow-side walls along a horizontal line for adjusting a size of the slab to be output, and first and second holding parts respectively connected between said first and second cassette holders and said first and second narrow-side walls for holding said first and second narrow-side walls at a constant horizontal level along the horizontal line, wherein said first holding part comprises a drivable rope drum arranged on said first cassette holder, a first rope connected between said drivable rope drum and a holding point on said first narrow-side wall, said first rope being guided at an angle ($\alpha$) relative to said first narrow-wall.

7. The adjustable plate mold of claim 6, wherein said first holding part further comprises a second rope connected between said drivable rope drum and a second holding point on said first narrow-side wall and rollers arranged at two ends of said first cassette holder respectively guiding said first and second ropes to said first and second holding points.

8. The adjustable plate mold of claim 1, wherein said first holding part further comprises a two arm lever connected to said first cassette holder and a drive for pivoting said two-arm lever with respect to said first cassette holder, said rod being connected at one end of said two-arm lever.

9. The adjustable plate mold of claim 1, further comprising a measuring and regulating device connected with said first and second actuating drives and with said first and second holding parts for effecting said movement along the horizontal line.

* * * * *